US007625226B1

(12) United States Patent
Gastineau

(10) Patent No.: US 7,625,226 B1
(45) Date of Patent: Dec. 1, 2009

(54) RADIAL ANTI-ROTATION COUPLING

(75) Inventor: Douglas Reid Gastineau, Costa Mesa, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 12/315,335

(22) Filed: Dec. 2, 2008

(51) Int. Cl.
*H01R 4/38* (2006.01)

(52) U.S. Cl. ..... 439/321

(58) Field of Classification Search ..... 439/321, 439/320, 318

See application file for complete search history.

(56) References Cited

U.S. PATENT DOCUMENTS 3,517,371 A * 6/1970 Joseph ..... 439/321
3,669,472 A * 6/1972 Nadsady ..... 285/87
4,239,314 A * 12/1980 Anderson et al. ..... 439/321
4,726,782 A 2/1988 Hager et al.
4,808,117 A * 2/1989 Gale et al. ..... 439/192
4,808,123 A 2/1989 Dee et al.
4,820,184 A 4/1989 Brandes
5,399,096 A 3/1995 Quillet et al.
5,580,278 A 12/1996 Fowler et al.
6,123,563 A * 9/2000 Johnson et al. ..... 439/321
6,135,800 A 10/2000 Majors
6,152,753 A 11/2000 Johnson et al.
6,183,293 B1 2/2001 Kieninger

* cited by examiner

*Primary Examiner*—Michael C Zarroli
(74) *Attorney, Agent, or Firm*—Peter Van Winkle

(57) ABSTRACT

A connector that has a coupling nut (14) that is rotatable about a barrel (12), with an annular space (42) between them, and with a resistance ring (40) lying in the annular space. The resistance ring allows the nut to rotate with moderate friction in a mating direction M, and provides higher resistance to nut rotation in an unmating direction U. The resistance ring is formed from a metal band with primarily straight band sections (60, 62, 64, 66) that alternately extend at inward and outward inclines from the circumference direction C. As a result, the resistance ring zig-zags by alternately engaging the nut surface (52) that faces the annular space, then the barrel surface (50) that faces the annular space, etc. Some of the radially outer ends of the straight sections are bent into small half circles (67) that fit into corresponding slots (68) in the nut to fix the resistance ring relative to the nut. The radially inner ends of the straight sections form bumps (70) that ride over saw teeth (74, 76) formed on the barrel surface.

7 Claims, 2 Drawing Sheets

10
40
M
U
16
20
22
26
12
82
70
67
30
14

M
U
67
68
66
62
60
64
14
82
52
12
50
C
70
26
40
42
80

D
M
U
A
B
C
E
G
67
68
66
62
80
64
60
52
67
50
40
66
12
42
14
26
76
72
74
70

RADIAL ANTI-ROTATION COUPLING

BACKGROUND OF THE INVENTION

One type of connector includes a barrel for holding a body with passages that hold contacts (usually electrical contacts but possibly optical contacts). A coupling nut is rotatably mounted on the barrel so the nut can be rotated to thread it onto a mating second connector that has mating contacts. It is usually desirable to allow nut rotation with only a moderate resistance in a mating direction to mate the two connectors, and to provide a much higher resistance to nut rotation in the opposite unmating direction. One type of mechanism includes a ring that is mounted on the barrel and lies in the annular space between the barrel and nut, with the ring bent to form multiple closely-spaced ratchets that engage pins on the nut. The multiple closely spaced ratchets result in a ring with limited resilience and corresponding limited reliability. A resistance ring that could be easily placed in the annular space between the barrel and nut and that provided high resilience to reliably provide controlled resistance to nut rotation in each direction, would be of value.

SUMMARY OF THE INVENTION

In accordance with one embodiment of the invention, a connector is provided with a resistance ring lying in the annular space between a barrel and coupling nut to provide controlled resistance to nut rotation in mating and unmating directions, which results in a highly resilient resistance ring for reliable operation. The resistance ring has primarily straight ring sections that zig zag between the barrel and nut surfaces that face the annular space. The ring sections are inclined by less than 45° and preferably less than 30°, to the circumferential direction, so the inclined ring sections extend primarily circumferentially.

The resistance ring can be formed of a band of sheet metal. The radially outer ends of some of the ring sections are formed into sharp bends that are preferably half circles, and the nut surface is formed with slots that receive the bends, to fix the resistance ring position relative to the nut. The radially inner ends of some of the ring sections form bumps, and the barrel surface forms a ring of saw teeth that the bumps ride over. Different sides of the saw teeth extend at different angles to the circumferential direction, and therefore provide different resistance to the bumps riding over them.

The half circle bends in outer ends of the ring sections are uniformly spaced about the axis, and the slots in the nut are correspondingly spaced about the axis. This allows the resistance ring to be placed in the annular space, and its half circle bends will fall into the slots.

The novel features of the invention are set forth with particularity in the appended claims. The invention will be best understood from the following description when read in conjunction with the accompanying drawings.

DESCRIPTION OF THE INVENTION

Figure 1:
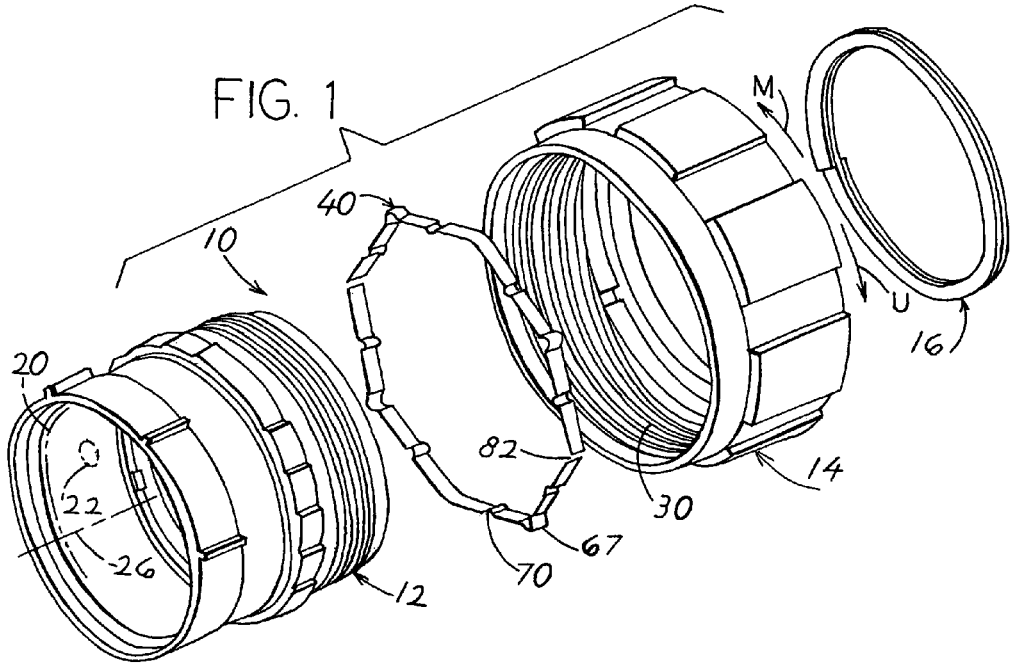
FIG. 1 is an exploded isometric view of a connector of the present invention.
Figure 2:
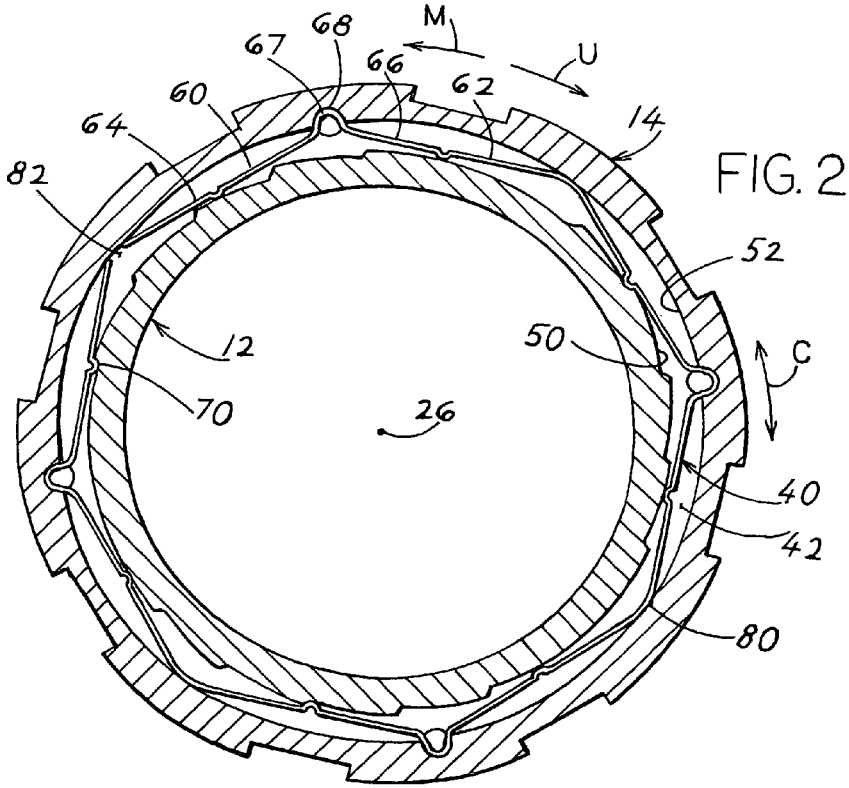
FIG. 2 is a sectional view taken on the axis of the connector of FIG. 1 after it is assembled.

FIGS. 1 and 2 show an electrical connector 10 of the present invention which includes a barrel element 12 and a coupling nut element 14. A snap ring 16 holds the barrel and nut together while allowing the nut to rotate without limit about the barrel. The barrel 12 is used to hold a dielectric body 20 that has passages 22 that hold contacts and wires. The connector has a connector axis 26. The nut 14 is rotatable by hand about the barrel, with such rotation being used to engage internal threads 30 on the nut with threads of a mating connector (not shown) that the connector 10 mates to. During mating the nut is turned in a mating direction M, and during unmating the nut is turned in the unmating direction U.

It is desirable to provide moderate resistance to turning of the coupling nut during mating. However, it is desirable to provide a much higher resistance to turning of the nut during unmating to prevent unintentional nut turning and corresponding unintentional unmating of the connectors. The connector includes a mechanism for accomplishing this that includes a resistance ring 40 that lies in an annular space 42 between the barrel and nut. The barrel and nut have annular space surfaces 50, 52 that face the annular space. The resistance ring has inward and outward inclined sections that follow zig-zag paths between the inward and outward annular face surfaces 50, 52 formed respectively on the barrel and nut. Specifically, the inward ring sections 60,62 extend at inward inclines relative to the circumferential direction C, from the outer surface 52 to the inner surface 50 of the annular space as we progress along the mating direction M. The resistance ring also has outward ring sections 64, 66 that extend at outward inclines from the inner surface 50 to the outer surface 52. In the resistance ring illustrated in FIG. 3, two sections 62, 66 are aligned (within 15°) and there is an angle G of about 40° (20° to 90°) between two sections 60, 66 that are connected by a loop 67 or that are connected by an obtuse bend 80. The angle G of about 40° from parallelism allows the ring to zig-zag in the annular space 42.

Figure 3:
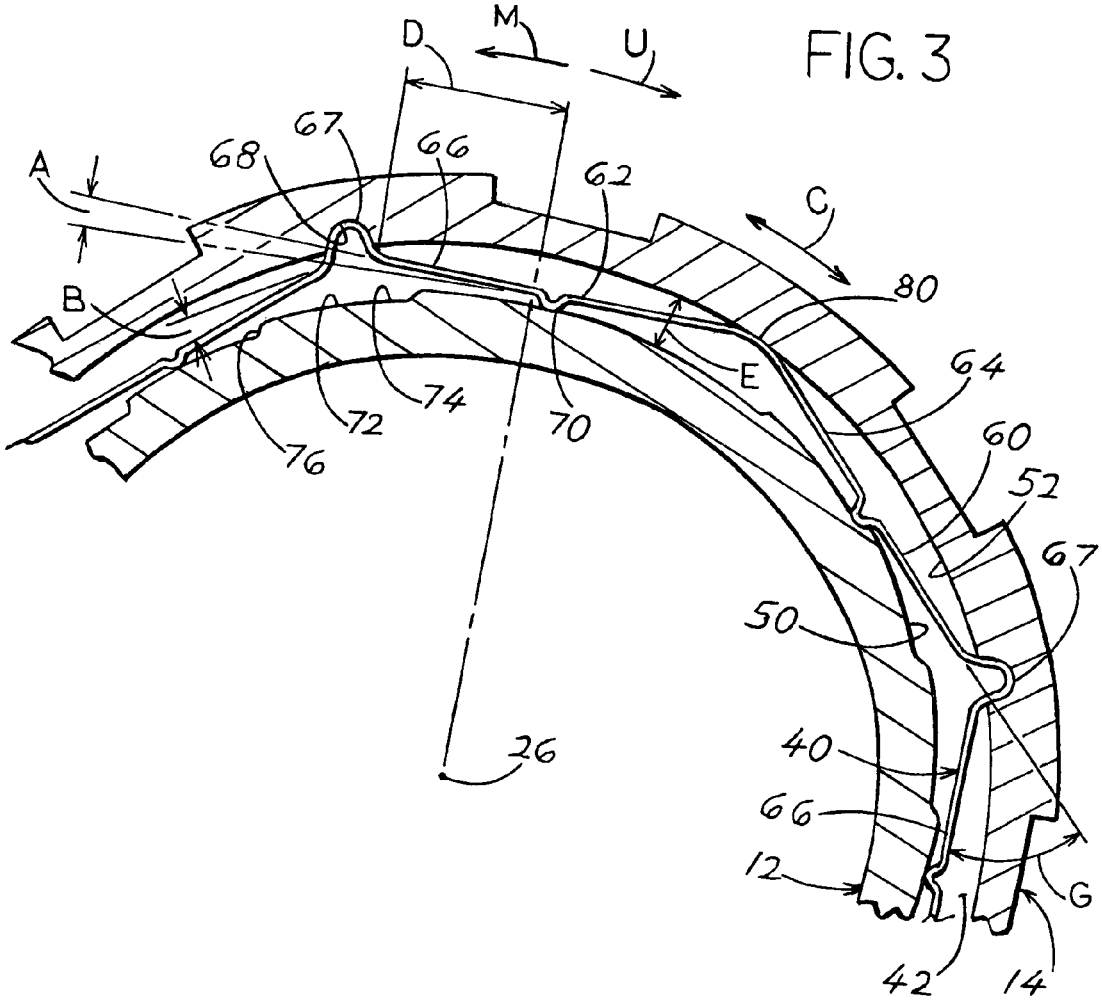
FIG. 3 is an enlarged view of a portion of the connector of FIG. 2.

As shown in FIG. 3, the incline angles A and B are small, with the angles A and B being less than 45° and usually less than 30°, and with the actual angles A and B illustrated being about 10° (4° to 20°). This results in the inclined sections extending primarily circumferential C along distances D which are a plurality of times the average radial distance E between the annular space surfaces 50, 52. The resistance ring is preferably formed from a metal band, and the long inclined sections result in the reliable application of spring forces that press the spring sections radially inward and outward. The resistance ring has a plurality of outer anchors 67 in the form of loops bent into half circles in the metal band. The nut surface 52 serves as an anchor surface that has corresponding slots 68 that receive the loops. The loops reliably remain in the slots 68. Applicant notes that he forms the slots 68 by drilling round holes in the nut in directions parallel to the axis 26.

The resistance ring has a plurality of bumps 70 at the radially inner ends of its inclined sections. The barrel surface 50 is formed with a plurality of teeth 72 that have inclines. The teeth are saw teeth, with gently inclined tooth surfaces 74 and with steeply inclined (from the circumferential direction C) tooth surfaces 76 facing partially in opposite circumferential directions M, U. That is, the gently inclined surfaces 74 face slightly in the unmating direction U and are angled by less than 15° from the circumferential direction C. When the nut is turned in the mating direction M the bumps 70 ride over the gently inclined teeth 74 which offer only a small resistance to turning. When the nut is turned in the unmating direction U the bumps 70 ride over the steeply inclined teeth surfaces 76 which offer high resistance. The surfaces 76 are angled by more than 15° from the circumferential direction and face in the mating direction M. The bumps encounter the steeply inclined teeth about every 18° of nut turning. The bumps 70 are preferably formed by sharp bends in the band that forms the resistance ring.

Applicant notes that the resistance ring has four anchor loops 67 and has four bends 80 that lie between the anchor loops and that merely press against the nut surface 52. The bends 80 allow the resistance ring to zig-zag though an annular space 42 of small radial thickness. Applicant also notes that there is a single gap 82 in the resistance ring. The resistance ring tends to expand and the gap 82 allows for such expansion so the bumps press radially inwardly against the saw teeth. Applicant can place the gaps elsewhere, such as along one of the half circles 67. Applicant can insert the resistance ring into the annular space 42, and the four loops 67 find their way into the slots 68 and reliably remain in place. The slots are preferably uniformly spaced about the axis to automatically receive the loops. There are preferably at least three slots and corresponding loops with the illustrated connector having four slots 68 spaced, or angled, 90° apart around the axis 26 and with four loops 67 angled 90° apart.

Each of the inclined sections 60, 62, 64, and 66 extend primarily straight. That is, the distance D between the opposite ends of the section is at least 67% and preferably 75% of the distance between the ends if the inclined section is straightened to extend along a line. Pairs of inclined sections such as 60, 64 and 62, 64 each extend primarily tangent to the barrel annular space surface 50, with angles of 180°-G, which are about 140°, between two of such pairs.

Thus, the invention provides a resistance ring that lies in an annular space between a barrel and nut and provides controlled resistance to rotation of the nut in mating and unmating directions. The resistance ring has inclined ring sections that zig-zag between the barrel and nut surfaces that face the annular space between the barrel and nut. The resistance ring forms anchors that are uniformly spaced about the connector axis and that lie in slots in one of the connector elements such as the nut. The resistance ring also forms bumps that engage sawteeth on the other element such as the barrel, to provide controlled resistance to nut rotation.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector that includes a barrel element for holding a contact-mounting body and a nut element that is rotatable about an axis around said barrel element, with an annular space lying between said barrel and nut elements, and with a resistance ring lying in said annular space and engaging both the barrel and nut elements to allow but resist nut rotation about the axis, wherein:

said resistance ring has alternate inward and outward ring sections that extend in alternate inward and outward inclines to directions that are circumferential to said axis, with each inward ring section extending in a first circumferential direction (M) at a radially inward incline (B) of a plurality of degrees but less than 45° to said first circumferential direction from said nut to said barrel, and with each outward section extending in said first circumferential direction (M) but at a radially outward incline (A) of a plurality of degrees but less than 45° from said barrel to said nut;

a plurality of said outward ring sections (66) having first ends (67) held against movement relative to a first of said elements, and a plurality of said inward ring sections having second ends (70) that slide only with resistance along a second of said elements.

2. The connector described in claim 1 wherein:

said second of said elements forms saw teeth with first sides (74) extending at inclines of no more than 15° to a circumferential direction (C), and with second sides (76) extending at reverse inclines of more than 20° to a circumferential direction (C).

3. The connector described in claim 1 wherein:

said resistance ring comprises a band with a plurality of outer loops (67) and a plurality of inner loops (70);

said barrel and nut elements have radially-facing surfaces (50, 52) that face said annular space, with one of said surfaces having a plurality of slots (68) that each surrounds the first of said loops to prevent the first of said loops from moving out of the slots, and with the other of said surfaces having a plurality of teeth with steeply incline teeth surfaces (76) that are inclined at least 15° from a circumferential direction (C) to allow the second of said loops to ride in a first direction of turning (U) over the steeply inclined teeth surfaces but to resist nut turning in said first direction.

4. The connector described in claim 3 wherein:

said slots (68) are uniformly angled about said axis and said loops are uniformly angled about said axis.

5. A connector that includes a barrel element for holding a contact-mounting body and a nut element that is rotatable on said barrel element about an axis, said elements forming an annular space between them and forming annular space surfaces facing said annular space, wherein the annular space surface of a first of said elements forms a ring of teeth and the annular space surface of the second element forms an anchor surface, and said apparatus includes a resistance ring that lies in said annular space and engages said ring of teeth and said anchor surface and resists but allows relative rotation of said elements, wherein:

said anchor surface has a plurality of radial recesses therein, with said recesses being spaced apart about said axis;

said resistance ring is bent to form a plurality of loops that each lies in one of said recesses, said resistance ring is bent to form a plurality of bumps that each engages said ring of teeth, and said resistance ring forms a plurality of connecting sections that each connects a loop and a bump, with each connecting section being longer than one of said loops and than one of said bumps and with each connecting section extending at an incline to spanning a majority of the radial distance between said radially facing surfaces.

6. The connector described in claim 5, wherein:

each of said loops in said resistance ring extends approximately 180° and lies primarily in one of said recesses in said support surface.

7. The connector described in claim 5 wherein:

said loops comprise at least three loops that are uniformly spaced about said axis.

* * * * *